United States Patent [19]

Barnard

[11] 4,224,913

[45] Sep. 30, 1980

[54] VEHICLE AIR-FUEL CONTROLLER HAVING HOT RESTART AIR/FUEL RATIO ADJUSTMENT

[75] Inventor: Michael L. Barnard, East Jordan, Mich.

[73] Assignee: General Motors Corporation, Detroit, Mich.

[21] Appl. No.: 66,018

[22] Filed: Aug. 13, 1979

[51] Int. Cl.[3] ..... F02N 17/08

[52] U.S. Cl. ..... 123/440; 123/179 G

[58] Field of Search ..... 123/32 EG, 32 EB, 32 EE, 123/119 EC, 179 G, 179 L

[56] References Cited

U.S. PATENT DOCUMENTS

| | | | |
|---|---|---|---|
| 3,705,571 | 12/1972 | Horn et al. | 123/32 EG |
| 3,923,031 | 12/1975 | Keranen | 123/32 EG X |
| 4,027,641 | 6/1977 | Moder | 123/179 L |
| 4,043,310 | 8/1977 | Ichimiya et al. | 123/179 G |
| 4,094,292 | 6/1978 | Takagi et al. | 123/32 EG X |
| 4,114,570 | 9/1978 | Marchak et al. | 123/32 EG |
| 4,157,699 | 6/1979 | Mori | 123/32 EG X |

*Primary Examiner*—Tony M. Argenbright
*Attorney, Agent, or Firm*—Howard N. Conkey

[57] ABSTRACT

An air/fuel ratio controller for an engine determines a hot restart condition by comparing the prior engine shutdown temperature with a predetermined constant and with the engine startup temperature. If the prior engine shutdown temperature exceeds the predetermined constant and the difference between the engine shutdown temperature and the engine startup temperature is within a predetermined value, a hot restart condition is indicated and the open loop air/fuel ratio otherwise determined in accord with engine operating parameters is adjusted to provide for improved hot restart engine performance.

3 Claims, 6 Drawing Figures

VEHICLE AIR-FUEL CONTROLLER HAVING HOT RESTART AIR/FUEL RATIO ADJUSTMENT

This invention relates to an air/fuel ratio controller for use with an internal combustion engine. More specifically, this invention relates to an airfuel controller which senses a hot restart condition and provides an adjustment of air/fuel ratio of the mixture supplied to the engine upon restart to thereby provide improved hot restart performance.

Air and fuel ratio controllers for adjusting the mixture of the fuel and air supplied by the carburetor to an internal combustion engine or the air/fuel ratio of the mixture supplied by a fuel injection system of an internal combustion engine are generally known. Typically, during cold engine operation, the carburetor or fuel injectors are controlled on an open loop basis to provide an air/fuel ratio according to a predetermined schedule determined to produce desired engine operation. When the engine is heated, the systems typically include a closed loop controller responsive to an oxygen sensor monitoring the oxidizing/reducing conditions in the exhaust gases for adjusting the air/fuel ratio to a predetermined ratio such as the stoichiometric ratio.

When an engine is first started, the air-fuel control system typically operates open loop for a predetermined time period before the closed loop control is initiated. During this open loop mode, the engine fuel requirements are determined on an open loop basis in accord with a predetermined schedule in response to the engine operating conditions. However, if an engine is restarted and is hot as a result of prior engine operation, the supplying of fuel to the engine in accord with the open loop schedule in response to the engine operating parameters may result in an excessively rich air-fuel mixture being supplied to the combustion chambers of the engine. For example, during hot restart, the fuel vaporization characteristics of the engine tend to produce the excessively rich mixture when the normal open loop air and fuel mixture is supplied.

In accord with this invention, a hot engine restart condition is detected and the fuel supplied to the engine in accord with the open loop schedule is modified so as to provide an air and fuel mixture that is more appropriate for engine operation during the hot engine restart condition.

The general object of this invention is to provide an improved air and fuel mixture controller for an internal combustion engine.

Another object of this invention is to provide an air and fuel mixture controller for an internal combustion engine wherein the open loop air and fuel mixture is adjusted in response to a sensed hot engine restart to provide for improved engine operation.

It is another object of this invention to provide an air and fuel mixture controller for an internal combustion engine wherein the open loop air and fuel mixture is adjusted in response to a sensed hot engine restart determined by a comparison of the engine startup temperature and the previous engine shutdown temperature retained in memory.

The invention may be best understood by reference to the following description of a preferred embodiment and the drawings in which.

Figure 1:
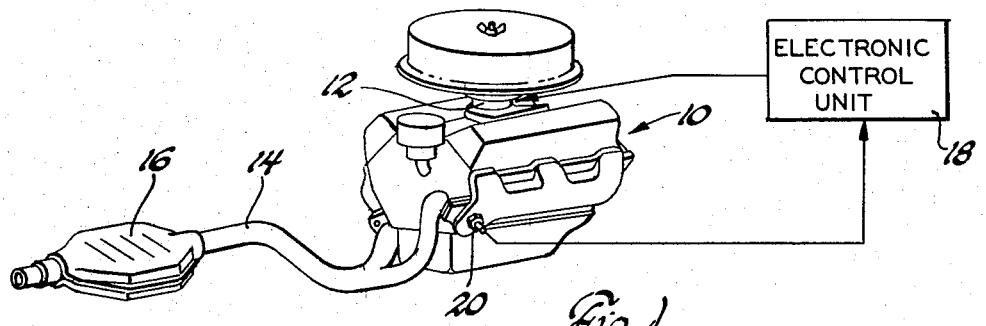
FIG. 1 illustrates an internal combustion engine incorporating a control system for controlling the air/fuel ratio of the mixture supplied to the engine in accord with this invention.

Referring to FIG. 1, an internal combustion engine 10 is supplied with a conrolled mixture of fuel and air by a carburetor 12. The air and fuel mixture forms a combustible mixture that is drawn into the engine intake manifold and thereafter into respective cylinders and burned. The combustion byproducts from the engine 10 are exhausted to the atmosphere through an exhaust conduit 14 which includes a three-way catalytic converter 16 which simultaneously converts carbon monoxide, hydrocarbons and nitrogen oxides if the air-fuel mixture supplied thereto is maintained near the stoichiometric value.

The air/fuel ratio of the mixture supplied by the carburetor 12 is selectively controlled in either an open loop or closed loop mode by means of an electronic control unit 18. During open loop control, the electronic control unit 18 is responsive to predetermined engine operating parameters to adjust the air/fuel ratio of the mixture supplied by the carburetor 12 in accord with a predetermined open loop schedule. When the conditions exist for closed loop operation, the electronic control unit 18 is responsive to the output of an air/fuel ratio sensor 20 positioned at the discharge point of one of the exhaust manifolds of the engine 10 and which senses the exhaust discharge therefrom to adjust the carburetor 12 so as to provide a predetermined air/fuel ratio such as the stoichio-metric ratio.

The sensor 20 is preferably of the zirconia type which generates an output voltage that achieves its maximum value when exposed to rich air-fuel mixtures and its minimum value when exposed to lean air-fuel mixtures. A characteristic of this type of sensor is that it is incapable of providing a usable output signal that may be used to adjust the air-fuel mixture until it is heated either by a heating element or the exhaust gases to an operating temperature such as 600° F.

When the conditions exist for closed loop operation, including the sensor 20 attaining its operating temperature, the electronic control unit 18 responds to the output of the sensor 20 and generates a closed loop control signal for controlling the carburetor 12. This signal includes integral and proportional terms that vary in amount and sense tending to restore the air/fuel ratio of the mixture supplied to the engine 10 to the desired ratio, which may be the stoichiometric ratio. The carburetor 12 includes an air/fuel ratio adjustment device that is responsive to the open loop and closed loop control signal outputs of the electronic control unit 18 to adjust the air/fuel ratio of the mixture supplied by the carburetor 12.

In the present embodiment, the control signal output of the electronic control unit 18 takes the form of a pulse width modulated signal at a constant frequency thereby forming a duty cycle modulated control signal. The pulse width of the signal output of the electronic control unit 18 is controlled in accord with the open loop schedule during open loop operation and in response to the output of the sensor 20 during closed loop operation. The duty cycle modulated signal output of the electronic control unit 18 is coupled to the carburetor 12 to effect the adjustment of the air/fuel ratio supplied by the fuel metering circuits therein. In this respect, a low duty cycle output of the electronic control unit 18 provides for an enrichment of the mixture supplied by the carburetor 12 while a high duty cycle value is effective to lean the mixture.

An example of a carburetor 12 with a controller responsive to a duty cycle signal for adjusting the mixture supplied by both the idle and main fuel metering circuits is illustrated in the U.S. Pat. Application Ser. No. 869,454, filed Jan. 16, 1978, now abandoned, which is assigned to the assignee of this invention. In this form of carburetor, the duty cycle modulated control signal is applied to a solenoid which simultaneously adjusts elements in the idle and main fuel metering circuits to provide for the air/fuel ratio adjustments.

In general, the duty cycle of the output signal of the electronic control unit 18 may vary between 5% and 95% with an increasing duty cycle effecting a decreasing fuel flow to increase the air/fuel ratio and a decreasing duty cycle effecting an increase in fuel flow to increase the air/fuel ratio. The range of duty cycle from 5% to 95% may represent the change in four air/fuel ratios at the carburetor 12 of FIG. 1.

Figure 2:
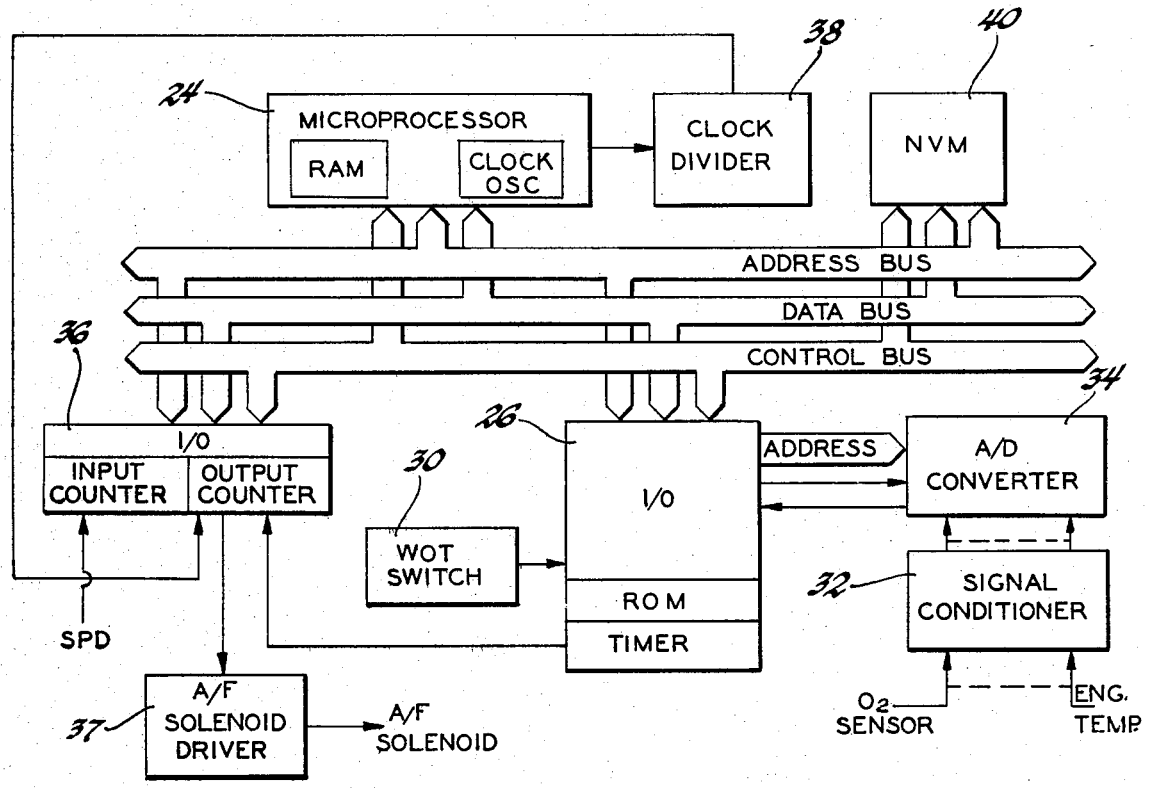
FIG. 2 illustrates a digital computer for controlling the air and fuel mixture supplied to the engine of FIG. 1 in accord with the principles of this invention.

Referring to FIG. 2, the electronic control unit 18 in the present embodiment takes the form of a digital computer that outputs a pulse width modulated signal at a constant frequency to the carburetor 12 to effect adjustment of the air/fuel ratio. The electronic control unit 18 determines the required pulse width during open loop operation in accord with a predetermined schedule in response to measured engine operating parameters and determines the pulse width during closed loop operation in response to the air/fuel ratio sensed by the sensor 20.

The digital system includes a microprocessor 24 that controls the operation of the carburetor 12 by executing an operating program stored in an external read only memory (ROM). The microprocessor 24 may take the form of a combination module which includes a random access memory (RAM) and a clock oscillator in addition to the conventional counters, registers, accumulators, flap flip-flops, etc., such as a Motorola Microprocessor MC 6802. Alternatively, the microprocessor 24 may take the form of a microprocessor utilizing an external RAM and clock oscillator.

The microprocessor 24 controls the carburetor 12 by executing an operating program stored in a ROM section of a combination module 26. The combination module 26 also includes an input/output interface and a programmable timer. The combination module 26 may take the form of a Motorola MC 6846 combination module. Alternatively, the digital system may include separate input/output interface modules in addition to an external ROM and timer.

The input conditions upon which the open loop and closed loop control of air/fuel ratio are based are provided to the input/output interface of the combination circuit 26. The discrete inputs such as the output of a wide open throttle switch 30 are coupled to discrete inputs of the input/output interface of the combination circuit 26. The analog signals representing parameters such as air/fuel ratio from the sensor 20, manifold absolute pressure from a conventional pressure sensor, throttle position and engine temperature from a conventional temperature sensor such as a thermistor are provided to a signal conditioner 32 whose outputs are coupled to an analog-to-digital converter multiplexer 34. The particular analog condition to be sampled and converted is controlled by the microprocessor 24 via the address lines from the input/output interface of the combination circuit 26. Upon command, the addressed condition is converted to digital form and supplied to the input/output interface of the combination circuit 26.

The duty cycle modulated output of the digital system for controlling the air-fuel solenoid in the carburetor 12 is provided by a conventional input/output interface circuit 36 which includes an output counter for providing the output pulses to the carburetor 12 via an air-fuel solenoid driver circuit 37. The output counter of the input/output interface circuit 36 receives a clock signal from a clock divider 38 and a 10 hz. signal from the timer in the combination circuit 26. The circuit 36 also includes an input counter which receives speed pulses from a speed transducer or from the engine distributor and which may be used to gate clock pulses to a counter to determine speed.

The system further includes a nonvolatile memory 40 into which data can be stored and from which data may be retrieved. The nonvolatile memory 40 may take the form of a RAM having power continuously applied thereto directly from the vehicle battery and bypassing the engine ignition switch so that the contents therein are retained during the shutdown mode of the engine 10. Alternatively, the nonvolatile memory 40 may take the form of a memory having the capability of retaining its contents without the application of power thereto.

The microprocessor 24, the combination module 26, the input/output interface circuit 36 and the nonvolatile memory 40 are interconnected by an address bus, a data bus and a control bus. The microprocessor 24 accesses the various circuits and memory locations in the ROM and the nonvolatile memory 40 via the address bus. Information is transmitted between the circuits via the data bus and the control bus includes lines such as read-write lines, reset lines, clock lines, etc.

As previously indicated, the microprocessor 24 reads data and controls the operation of the carburetor 12 by execution of its operating program as provided in the ROM in the combination circuit 26. Under control of the program, various input signals are read and stored in ROM designated locations in the RAM in the microprocessor 24 and in the nonvolatile memory 40 and the calculations are performed for controlling the air and fuel mixture by the carburetor 12. The determined pulse width or duty cycle value for controlling the carburetor 12 is provided thereto via the input/output circuit 36.

Figure 3:
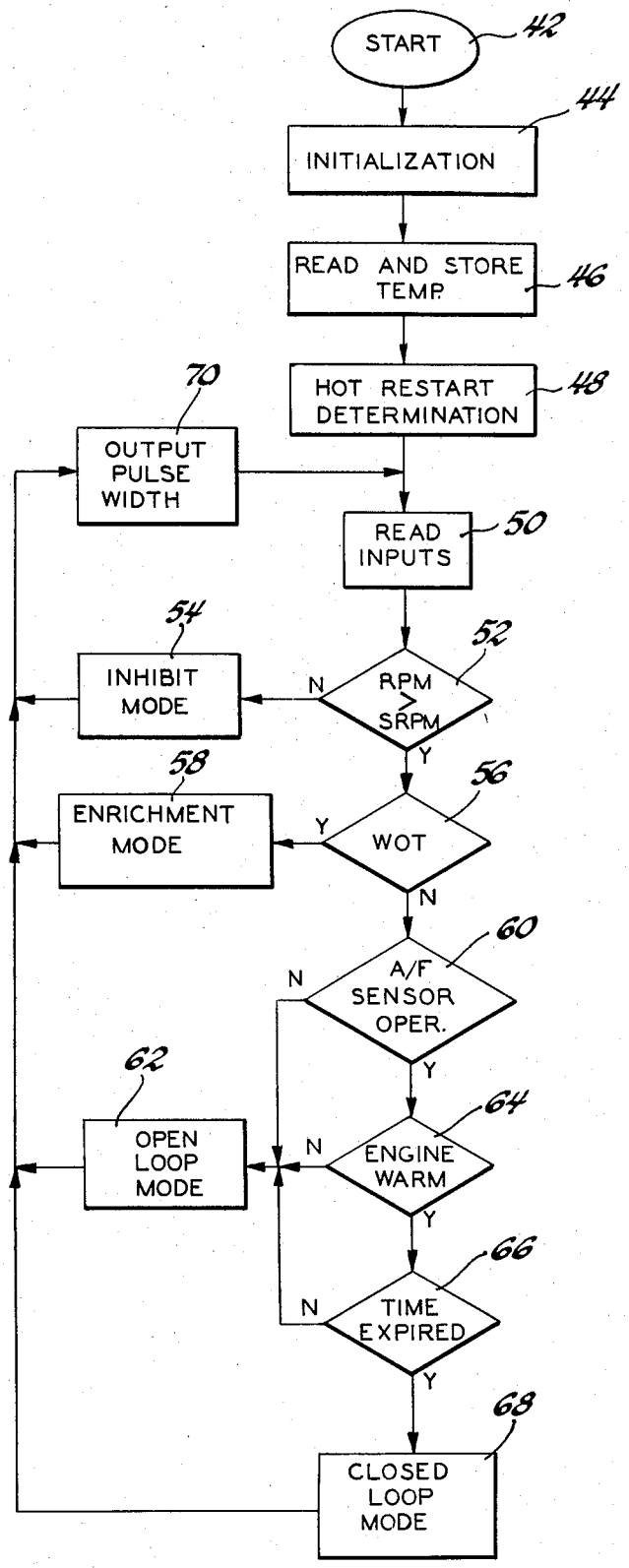
FIGS. 3 thru 6 are diagrams illustrative of the operation of the digital computer of FIG. 2 incorporating the hot restart fuel control principle of this invention.

Referring to FIG. 3, there is illustrated the major loop portion of the computer program. The major loop is reexecuted every 100 milliseconds which is the desired frequency of the pulse width modulated signal provided to the carburetor 12. This frequency is determined by the timer portion of the combination module 26. The computer program begins at point 42 when power is applied to the system by the vehicle operator. At step 44 in the program, the computer provides for initialization of the system. For example, at this step, system initial values are entered into ROM designated locations in the RAM in the microprocessor 24 and counters such as an elapsed time couner, etc. are reset. After the initialization step 44, the program proceeds to step 46 where the engine temperature is read and stored in a ROM designated location in the RAM. This temperature is the engine startup temperature which is utilized in accord with this invention to detect whether or not a hot restart condition exists.

Figure 4:
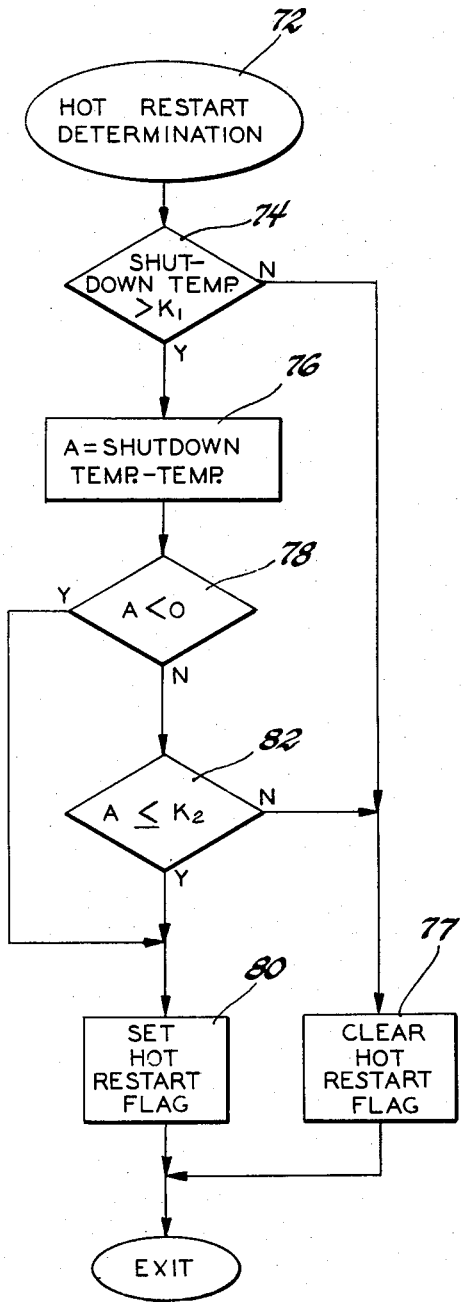

The computer program then proceeds to step 48 which is further detailed in FIG. 4 where it is determined if a hot restart condition exists. If a hot restart condition is detected at step 48, the open loop determined duty cycle is modified in accord with this invention to provide for improved engine performance during the hot restart condition.

The program then proceeds to step 50 wherein the computer executes a read routine where predetermined parameters such as the state of the $O_2$ sensor read during execution of the prior major loop are saved by inserting them in ROM designated RAM locations, the discrete inputs, such as from the wide open throttle switch 30 are stored in respective memory locations in the RAM, engine speed as determined via the input counter of the input/output circuit 36 is stored at a respective storage location in the RAM, and the various inputs to the analog-to-digital converter including the engine temperature signal are one by one converted by the analog-to-digital converter multiplexer 34 into a binary number representative of the analog signal. These signals are read into respective ROM designated storage locations in the RAM.

The computer program then proceeds to decision point 52 wherein engine speed as determined by the input counter section of the input/output circuit 36 is compared with a reference engine speed value SRPM that is less than the engine idle speed but greater than the cranking speed. If the engine speed is not greater than the reference speed SRPM, the program proceeds to an inhibit mode operation at step 54 where the determined width of the pulse width modulated signal for controlling the carburetor and which is stored at a RAM location designated by the ROM to store the carburetor control pulse width is set essentially to 0 to produce a zero per cent duty cycle signal for setting the carburetor 12 to a rich setting to assist in vehicle engine starting. If the engine speed is greater than the referenced speed SPRM indicating the engine is running, the major loop program cycle proceeds to a decision point 56 where the computer determines whether the engine is operating at wide open throttle thereby requiring power enrichment. This is accomplished by addressing the address location in the RAM at which the condition of the wide open throttle switch 30 was stored during step 50. If the engine is at wide open throttle, the program cycle proceeds to step 58 at which an enrichment routine is executed wherein the width of the pulse width modulated signal required to control the carburetor 12 for power enrichment is determined and stored at the RAM location assigned to store the carburetor control pulse width.

If the wide open throttle condition for power enrichment is not present, the major loop program proceeds to a decision point 60 where the operational condition of the air/fuel ratio sensor 20 is determined. In this respect, the system may determine operation of the sensor 20 by parameters such as sensor temperature or sensor impedance. If the air-fuel sensor 20 is determined to be inoperative, the program proceeds to step 62 at which an open loop routine is executed where an open loop pulse width is determined in accord with input parameters which may include the engine temperature read and stored in the RAM at program step 50. Additionally, if at step 48 it was determined that a hot restart condition exists, the otherwise determined open loop pulse width is modified in accord with the hot restart condition so as to provide for improved hot restart operation of the engine in accord with the principles of this invention. The determined open loop pulse width is stored at the RAM location assigned to store the carburetor control pulse width.

If at decision point 60 it is determined that the air-fuel sensor 20 is operational, the major loop program proceeds to decision point 64 at which the computer determines whether the engine temperature stored in the RAM at step 50 is greater than a predetermined value. If the temperature of the engine is below this value, the computer program proceeds to the step 62 and executes the open loop routine as previously described.

If the engine temperature determined at 64 is greater than the predetermined temperature, the program proceeds to decision point 66 where an elapsed time counter monitoring the time since engine startup is compared with a predetermined time representing the time criteria before the closed loop operation of the electronic control unit 18 is implemented. This timer may take the form of a counter that was set to zero at step 44 and which is incremented at point 66 in the program each 100 millisecond major loop cycle with the number of loops representing the elapsed time. If the elapsed time is less than a predetermined value, the program again proceeds to the open loop mode 62 where the open loop routine is executed as previously described.

If the time criteria at point 66 in the program has been met, all of the conditions exist for closed loop control of the air/fuel ratio and the major loop program proceeds to step 68 where a closed loop routine is executed to determine the carburetor control signal pulse width in accord with the sensed air/fuel ratio. The determined closed loop pulse width is stored at the RAM location assigned to store the carburetor control pulse width.

From each of the program steps 54, 58, 62 and 68, the program cycle proceeds to step 70 at which the carburetor control pulse width is read from the RAM and entered in the form of a binary number into the output counter of the input/output circuit 36. A pulse is then issued to the driver circuit 37 by the input/output circuit 36 having a duration determined by the number in the output counter and the clock frequency from the divider 38. The initiation of the pulse output of the input/output circuit 36 is controlled by the output timer in the input/output circuit 26 resulting in a pulse width at the computer program cycle rate which defines the variable duty cycle control signal for adjusting the carburetor 12.

Referring to FIG. 4, the hot restart determination routine 48 of FIG. 3 is illustrated. At step 72, the program enters the hot restart determination routine and thereafter proceeds to decision point 74 where the engine shutdown temperature, which is the temperature of the engine when the vehicle was last disabled, is read from the nonvolatile memory RAM 40 at a ROM designated location and compared with a constant value $k_1$ representing a minimum temperature that is representative of warm engine operation. The engine shutdown temperature was stored during the closed loop operating mode 68 during the prior vehicle engine operation as will be described with reference to step 68 of the program cycle of FIG. 3. If the prior shutdown temperature is less than the constant value $k_1$, the program cycle proceeds to step 76 where a hot restart flag flip-flop in the microprocessor 24 is cleared to indicate that the conditions are not representative of a hot restart. However, if the shutdown temperature is greater than the value $k_1$, the program proceeds to step 77 where the startup temperature read at step 46 of FIG. 3 is subtracted from the shutdown temperature read from the nonvolatile memory 40. The program cycle then proceeds to decision point 78 where it is determined whether or not the value A determined at step 76 is less than 0 representing the startup temperature being greater than the shutdown temperature. If the value A is greater than 0 representing a hot restart condition, the program cycle proceeds to step 80 where the hot restart flag flip-flop in the microprocessor is set to provide an indication that a hot restart condition exists. If at step 78 the value A was not less than 0, the program proceeds to decision point 82 where the value A is compared to a constant $k_2$. If the startup temperature has decreased below the shutdown temperature by an amount greater than $k_2$, the program proceeds to the step 76 where the hot restart flag flip-flop is cleared to indicate that the conditions are not representative of a hot restart. However, if the startup temperature has not decreased below the shutdown temperature by an amount greater than the value $k_2$, the program proceeds to the step 80 where the hot restart flag flip-flop is set to provide an indication that a hot restart condition exists. From the steps 76 and 80, the program cycle exits the hot restart determination routine and continues on to step 50 of FIG. 3.

Figure 5:
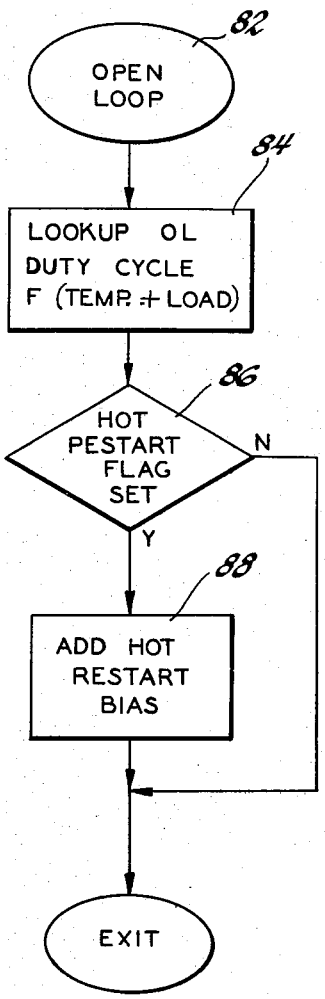

Referring to FIG. 5, there is illustrated a diagram of the program steps performed during the open loop mode 62 of FIG. 3 and which includes the hot restart adjustment of this invention.

The program enters the open loop routine at step 82 and proceeds to step 84 wherein an open loop pulse width or duty cycle is determined by a lookup routine. The pulse width value is obtained from a lookup table in the ROM at an address in accord with the engine operating parameters such as temperature and manifold absolute pressure read at step 50 of FIG. 3. The duty cycle resulting from this pulse width is determined to be the duty cycle required to attain the air/fuel ratio for providing desired engine performance during open loop operation.

During a hot restart condition, the value of duty cycle determined at step 84 may produce an excessively rich mixture during a hot restart condition as a result of, for example, the engine vaporization characteristics during a hot restart condition. Consequently, and in accord with this invention, the open loop duty cycle is modified when a hot restart condition has been determined to thereby obtain improved hot restart operation of the engine. This is accomplished after step 84 by the program cycle proceeding to the decision point 86 where the hot restart flag flip-flop condition established at step 48 in the program cycle of FIG. 3 is sampled. If the flag is reset, indicating a hot restart condition does not exist, the open loop routine is exited and the determined duty cycle at step 84 is provided to the carburetor at step 70 of FIG. 3. However, if the hot restart flag is set indicating a hot restart condition, the program proceeds to step 88 where a predetermined hot restart bias value stored in the ROM is added to the previously determined open loop pulse width at step 84. The resulting increased open loop duty cycle increases the air/fuel ratio of the mixture supplied by the carburetor 12 to provide for improved engine operation during the hot restart condition.

After step 88, the program exits the open loop routine and proceeds to step 70 of FIG. 3 wherein the open loop pulse width determined at step 88 is provided to the carburetor 12 to provide for the hot restart fuel adjustment.

Figure 6:
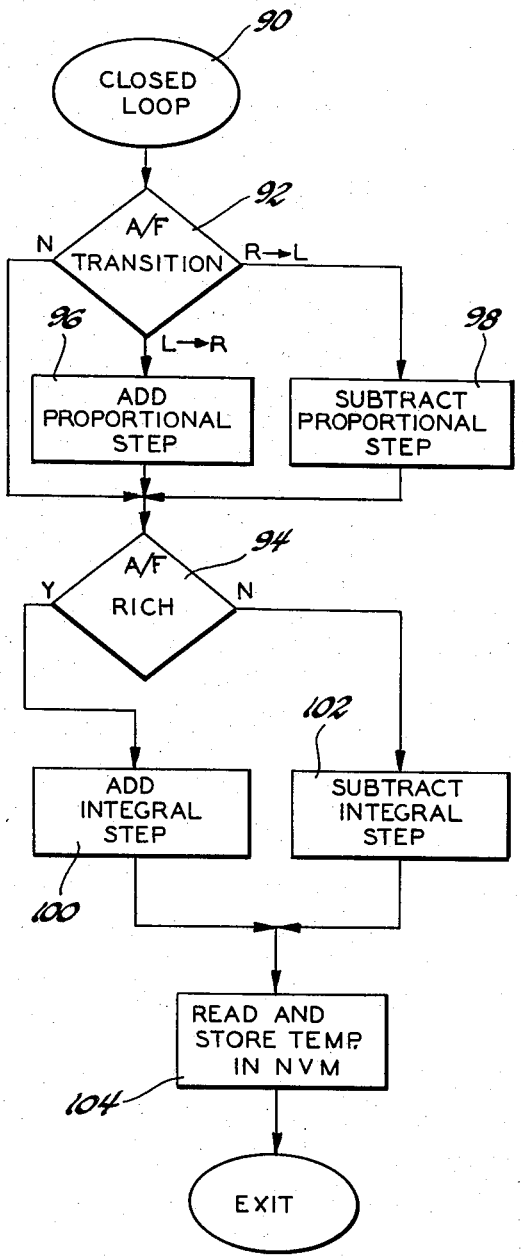

Referring to FIG. 6, there is illustrated a diagram of the program steps performed at step 68 in the major loop cycle of FIG. 3. The closed loop mode is entered at step 90 and then proceeds to a decision point 92 where the present state of the air/fuel ratio relative to the stoichiometric ratio is compared with the state of the air/fuel during the prior major loop cycle that was saved at step 50 to determine if there has been a transition in the air/fuel ratio relative to the stoichiometric ratio. If a transition has not occurred, only an integral term adjustment is required and the program cycle proceeds to a decision point 94. If a lean-to-rich transition is detected, the program proceeds to step 96 wherein a predetermined proportional term value stored in the ROM is added to the pulse width value stored in the RAM at the location where the control pulse width is stored to effect a proportional step increase in the duty cycle of the carburetor control signal. If a rich-to-lean transition is detected, the program proceeds to step 98 wherein a predetermined proportional term value stored in the ROM is subtracted from the previously determined closed loop pulse width stored in the RAM to effect a proportional step decrease in the calculated duty cycle of the carburetor control signal.

From either of the steps 96 or 98, the program cycle proceeds to the decision point 94 where the state of the air/fuel ratio is sensed. If the air/fuel ratio is rich relative to the stoichiometric value, the program cycle proceeds to step 100 where a predetermined integral step is added to the closed loop pulse width value stored in the RAM. If the air/fuel ratio is lean relative to the stoichiometric value, a predetermined integral step is subtracted at step 102 from the previously determined closed loop pulse width stored in the RAM. From the steps 100 or 102 the program proceeds to step 104 where the engine temperature is stored in the ROM designated location in the nonvolatime memory 40 which, at engine shutdown, represents the engine shutdown temperature used at the next engine restart to determine whether a hot restart condition exists as previously described. Since the engine temperature is stored in the nonvolatile memory each major cycle, the temperature is stored on a substantially continuous basis so that upon engine shutdown, the value of engine temperature stored is substantially the engine shutdown temperature. Thereafter, the program exits the closed loop routine and continues the major loop wherein the pulse width stored in the RAM is provided to the carburetor 12 at step 70. The closed loop routine of FIG. 6 is repeated at a 10 hz. rate resulting in an output duty cycle signal to the carburetor 12 that is comprised of proportional and integral correction terms in the form of step and ramp functions for adjusting the carburetor 12 in direction tending to produce the stoichiometric value.

The foregoing description of the invention for the purpose of illustrating the principles thereof is not to be considered as limiting or restricting the invention since many modifications may be made by the exercise of skill in the art without departing from the scope of the invention.

The embodiments of the invention in which an exclusive property or privilege is claimed are defined as follows:

1. An air/fuel control system for an internal combustion engine having supply means to supply a mixture of air and fuel to the engine, including, in combination:

means effective to sense engine temperature;

means responsive to engine shutdown effective to retain in memory the then sensed engine temperature; and means responsive to engine startup to adjust the supply means to supply air and fuel (1) at a ratio for cold engine operation determined in accord with predetermined engine operating parameters when the engine shutdown temperature retained in memory is less than a first value, (2) at said ratio determined in accord with predetermined engine operating parameters when the difference between the engine shutdown temperature retained in memory and the engine startup temperature is greater than a second value and (3) at a ratio offset from said ratio determined in accord with the predetermined engine operating parameters in the mixture leaning direction when the difference between the engine shutdown temperature retained in memory and the engine startup temperature is less than the second value representing a hot restart condition to thereby provide improved hot restart performance of the internal combustion engine.

2. An air-fuel control system for an internal combustion engine having supply means to supply a mixture of air and fuel to the engine, including, in combination:

means effective to sense engine temperature;

nonvolatile memory means;

means effective during engine operation to store the value of the sensed engine temperature in the nonvolatile memory on a substantially continuous basis so that upon engine shutdown, the value of temperature stored in the nonvolatile memory means is substantially the engine shutdown temperature; and means resonsive to engine startup to adjust the supply means to supply air and fuel (1) at a ratio for cold engine operation determined in accord with predetermined engine operating parameters when the engine shutdown temperature stored in the nonvolatile memory means is less than a first value, (2) at said ratio determined in accord with predetermined engine operating parameters when the difference between the engine shutdown temperature stored in the nonvolatile memory means and the engine startup temperature is greater than a second value and (3) at a ratio offset from said ratio determined in accord with the predetermined engine operating parameters in the mixture leaning direction when the difference between the engine shutdown temperature stored in the nonvolatile memory means and the engine startup temperature is less than the second value representing a hot restart condition to thereby provide improved hot restart performance of the internal combustion engine.

3. An air-fuel controller for an internal combustion engine having supply means to supply a mixture of air and fuel to the engine and a sensor providing a sensor signal in response to the air/fuel ratio of the exhaust gases discharged from the engine, including, in combination:

means effective to sense engine temperature;

nonvolatile memory means; and control means operable in an open loop operating mode at engine startup and thereafter in a closed loop operating mode when predetermined engine operating conditions are met, the control means including (1) means operable during the closed loop operating mode (a) to adjust the supply means in response to the sensor signal to vary the air/fuel ratio so as to establish a predetermined ratio and (b) to store the value of the sensed engine temperature in the nonvolatile memory means on a substantially continuous basis so that at engine shutdown, the value of temperature stored in the nonvolatile memory means is substantially the engine shutdown temperature and (2) means operable during the open loop operating mode to adjust the supply means to supply air and fuel (a) at a ratio for cold engine operation determined in accord with predetermined engine operating parameters when the engine shutdown temperature stored in the nonvolatile memory is less than a first value, (b) at said ratio determined in accord with the predetermined engine operating parameters when the difference between the engine shutdown temperature stored in the nonvolatile memory and the value of the sensed engine temperature at engine startup is greater than a second value and (c) at a ratio offset from said ratio determined in accord with the predetermined engine operating parameters in the mixture leaning direction when the engine shutdown temperature stored in the nonvolatile memory is greater than the first value and when the difference between the engine shutdown temperature stored in the nonvolatile memory and the value of the sensed engine temperature at engine startup is less than the second value representing a hot restart condition to thereby provide improved hot restart performance of the internal combustion engine.

* * * * *

UNITED STATES PATENT AND TRADEMARK OFFICE

CERTIFICATE OF CORRECTION

PATENT NO. : 4,224,913

DATED : September 30, 1980

INVENTOR(S) : Michael L. Barnard

It is certified that error appears in the above-identified patent and that said Letters Patent are hereby corrected as shown below:

Column 1, line 7, "airfuel" should be -- air-fuel --.

Column 2, line 35, "stoichio-metric" should read -- stoichiometric --.

Column 3, line 43, "flap" should read -- flag --.

Column 4, line 47, -- supplied -- should be inserted after "mixture".

Column 4, line 62, "couner" should read -- counter --.

Column 9, line 34, -- means -- should be inserted after "memory".

Signed and Sealed this

*Twenty-third* Day of *June 1981*

[SEAL]

*Attest:*

RENE D. TEGTMEYER

*Attesting Officer*

*Acting Commissioner of Patents and Trademarks*